United States Patent [19]

Davis

[11] 4,190,112

[45] Feb. 26, 1980

[54] PUMP DOWN WIPE PLUG AND CEMENTING/DRILLING PROCESS

[76] Inventor: Carl A. Davis, P.O. Box 12326, Houston, Tex. 77017

[21] Appl. No.: 941,162

[22] Filed: Sep. 11, 1978

[51] Int. Cl.[2] ..... E21B 33/16

[52] U.S. Cl. ..... 166/291; 166/153; 166/193; 175/57

[58] Field of Search ..... 166/99, 153, 170, 192, 166/193, 194, 237, 238, 285, 291, 242; 175/57

[56] References Cited

U.S. PATENT DOCUMENTS

| | | | |
|---|---|---|---|
| 2,075,882 | 4/1937 | Brantly | 166/291 X |
| 2,165,433 | 7/1939 | Wickersham | 166/153 |
| 2,854,079 | 9/1958 | Schnitter | 166/192 X |
| 2,893,493 | 7/1959 | Copas | 166/170 |
| 3,035,639 | 5/1962 | Brown et al. | 166/194 X |
| 3,552,492 | 1/1971 | Mullins | 166/237 |

*Primary Examiner*—James A. Leppink
*Assistant Examiner*—George A. Suchfield

[57] ABSTRACT

An improved pump down wipe plug has at least one tooth protruding from its bottom surface capable of engaging, denting and penetrating the surface on which the plug comes in contact within the well. An improved process of cementing and drilling through a plug comprises inserting a pump down wipe plug having at least one tooth protruding from its bottom surface at the interface of wet cement and another fluid within the well, pumping the wet cement and the plug into position so that the tooth engages, dents and penetrates the surface below it, then when the cement has set, lowering a drill bit onto the plug and drilling the plug, the tooth or teeth retarding the tendency of the plug to rotate over the surface with which it is in contact thereby enhancing the drilling action of the drilling bit.

16 Claims, 9 Drawing Figures

FIG. 1
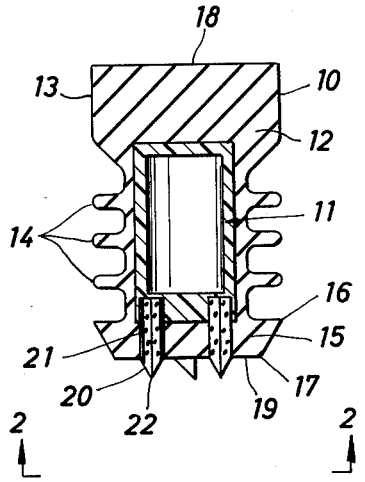
FIG. 3
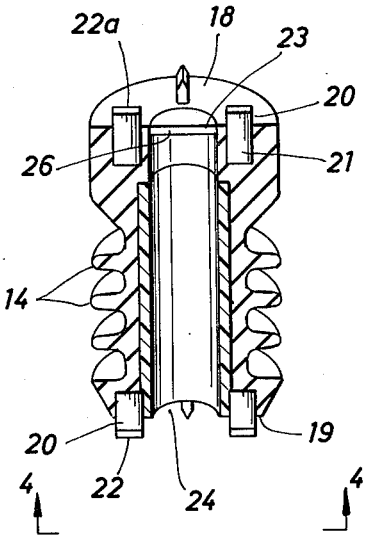
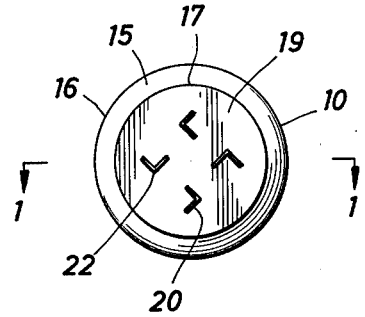
FIG. 2
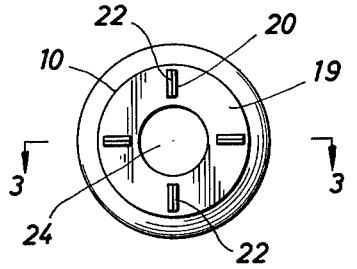
FIG. 4
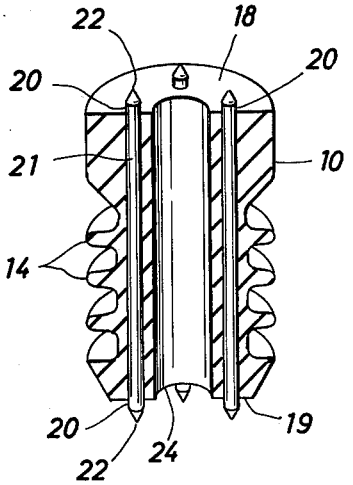
FIG. 5

PUMP DOWN WIPE PLUG AND CEMENTING/DRILLING PROCESS

BACKGROUND OF THE INVENTION

The cementing process is one of the most important processes in drilling and completing a well. It is an intimate part of the running of casing. Cementing is done at various points in the well and at various times while drilling both inside and outside of the casing.

The primary cementing can form a protective sheath around the casing, segregating producing formations to prevent migration of undesirable fluids. Secondary cementing takes place after the primary cementing and can be used to squeeze cement into the perforations in the casing or to seal off, isolate or repair parts of the well. Plug back cementing is used to place cement at desired points in the well or to shut off the bottom water or reduce the depth of the well.

Two of the apparatuses or pipe attachments routinely used in the cementing operations are the collar and the shoe. These are typically cement restrictions or shoulders which are attached to a pipe string as a part of the pipe string. The collar, for example a float collar, is inserted between the top and bottom of a casing string usually one or two joints above a float shoe which is attached to the bottom of a pipe string. Shoes and collars, among a number of things, help prevent the back flow of cement during the cementing operation. The collars and the shoes are usually equipped with a check valve (often a ball valve means) to aid in the prevention of back flow of cement. The shoes and collars are typically an outer cylindrical housing or pipe and an inner cement tube communicating with and fixed to the inner surface of the cylindrical housing, with a fluid passage running the length of the cement tube. When there is a check valve, it is usually part of an inner housing in concentric spaced relationship with the outer housing so that the cement tube fills the space between the two housings and the inner housing forms part of the fluid passage.

In addition to the collars and shoes typical cementing operations employ one or more pump down plugs. Pump down wipe plugs can serve three purposes: (1) to separate or serve as the interface between the wet cement from the fluid it is displacing or the fluid which is being used to pump the wet cement to the desired level; (2) to wipe off the inner surface of the pipe string as it passes; and (3) to help prevent back flow while the cement is setting up.

In practice the well operator makes up his pipe string so that the collar or shoe is lowered into the well to the desired level. When he decides to cement he may place a bottom pump down wipe plug between the fluid already in the well and the wet cement. This bottom plug has a fluid passage through it which is sealed by a diaphragm or membrane. The cement is pumped into the well forcing the bottom plug down the well, displacing the fluid in front of it, until it reaches the top of the cement tube of the shoe or collar or shoulder. This restriction stops the plug and increased pumping pressure breaks the diaphragm or membrane and the cement passes through the plug and through the fluid passage of the collar or shoe. After the desired amount of cement is pumped into the well a top pump down wipe plug is inserted to act as the interface between the fluid used to force the cement to the desired level for the cement. Often the bottom plug is not used and only one plug as the interface between the cement and the fluid used to force the cement to the desired level is used. The top plug is usually pumped until it comes in contact with the bottom plug if one is used or the top of the cement tube part of the shoe or collar. The cement is allowed to set or harden and the well operator then carries out whatever other operations he intends to do.

The plugs used in the above operation are usually made of a pliable or rubbery material, such as plastic, wood or rubber, sometimes with hollow metal or plastic cores and they fit snugly in the pipe string. All of the plug is made of drillable material.

Once the cement has set up and the well operator has carried out his desired operations he may decide to drill out the plug and/or plugs, collar or shoe and the cement. The plugs are typically made of drillable material, as are the cement tube and and innerhousing of the collar and shoe and of course, the cement which was pumped into the well. The well operator lowers the drill string into the well until the drill bit contacts the plug and he begins to drill by rotating the drill bit, usually clockwise. In many instances the rotation of the drill bit will cause the plug with which it is in contact to rotate, slipping over the surface on which it rests, i.e., cement, a bottom plug or the cement tube of the shoe or collar. This tendency of the plug to rotate as the bit rotates, to slide across the surface below it, wastes both time and energy. Since all of the components are made of readily drillable material, this wasting of time and energy in the drilling process is an unnecessary problem.

The present invention is an improved cementing pump down wipe plug and a method for drilling through the cementing pump down wipe plug.

SUMMARY OF THE INVENTION

This invention relates to an improved pump down wipe plug having at least one drillable metal, plastic or wooden protrusion or tooth extending from the bottom surface. The invention also relates to an improved bottom pump down wipe plug having at least one metal, plastic or wooden protrusion or tooth-means extending from the top surface of the plug. It further relates to an improved bottom pump down wipe plug having at least one protrusion extending from the top surface and at least one protrusion extending from the bottom surface. The invention relates to a process of drilling through a pump wipe down plug where the pump down wipe plug is held stationary or if tending to rotate retarded by at least one metal, wooden or plastic protrusion extending from the bottom surface of the plug into solid cement or stationary second plug below the first plug. It also relates to the process of drilling through a top pump down wipe plug where the top pump down wipe plug is held stationary by at least one sharp protrusion extending from the top surface of the bottom plug. It further relates to the process of drilling through the top and bottom pump down wipe plugs where the top plug is held stationary by at least one protrusion or tooth-like means extending from the surface of the bottom plug and the bottom plug is held stationary by at least one protrusion extending from the bottom of the bottom plug into solid cement.

BRIEF DESCRIPTION OF THE DRAWINGS

FIG. 1 is a sectional view of the improved pump down wipe plug along the line 1—1 of FIG. 2.

FIG. 2 is a head on view of the bottom of the improved plug of FIG. 1.

FIG. 3 is a sectional view of an improved bottom pump down wipe plug taken through the line 3–3′ when the plug was made with a hollow core.

FIG. 4 is a view of the improved plug of FIG. 3 from the top.

FIG. 5 is a sectional view of an improved bottom plug.

DESCRIPTION OF PREFERRED EMBODIMENTS

Figure 6:
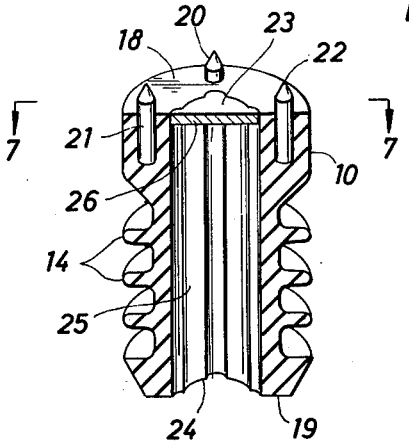
FIG. 6 is a sectional view of the improved plug of FIG. 7 along the line 4—4′.

The invention will be further described by detailed reference to the Figures.

FIG. 1 is an illustration of the improved plug 10 where the plug 10 is made with a core 11 which in this embodiment is hollow and can be made of drillable plastic, wood or metal. The core 4 is molded into the body of the plug 12 which is made of rubber or plastic. Typical plugs as shown in FIGS. 1–7 are shaped with a top section whose diameter is large enough so that the section exerts a positive wiping and sealing action on the pipe with which it communicates. It also has one or more fins 14 which also serve to wipe and seal and a bottom section 15 where the top of the bottom section 16 is the same diameter as the fins and the bottom of the bottom section 17 has a diameter slightly less than the fins. The top of the plug 18 and the bottom of the plug 19 are normally flat or perpendicular to a line through the longitudial center of the plug or the pipe in which it travels.

The improvement illustrated in the FIGS. 1–7 are the protrusions 20 which protrude from the bottom surface of the plug 19 in FIG. 1, the bottom and the top surfaces 18 and 19 of the plug 10 in FIGS. 3 and 4 and the top surface of the plug 18 in FIG. 6. There is at least one protrusion 20 on each plug 10. These protrusions are part of a rod, bar or angle iron 21 which is embedded and fixed into the body 12 and sometimes the core 11 (FIG. 1) of the plug 10. The rod, bar or angle iron 21 are made of a material strong enough to stop or retard the rotation of the plug 10 caused by the action of the rotating drill bit without breaking. Typical materials are drillable metals, plastics and wood. The preferred materials are metals and the preferred metals are cast iron and aluminum, the most preferred metal is aluminum.

The minimum length of the protrusion 20 is about 1.27 centimeters, preferably between about 1.27 centimeters and about 8 centimeters, most preferably between about 2.5 and about 5 centimeters above the surface 18 or 19 of the plug 10. The total length of the rod, bar or angle iron 21 (the protrusion plus that part below the surface) is between about 4 centimeters and about 16 centimeters greater than the length of the plug 10. It should be recognized that the length of the protrusions or teeth-like means 20 and the bar, rod or angle iron 21 are dependent on how easily the protrusion 20 penetrates the surface in front of it and how solidly the rod, bar or angle iron 21 is held in the plug 10.

The tip or end of the protrusion furthest from the surface from which it protrudes 22 is preferably sharp, either a point or an edge or blade (22*a*) capable of engaging or penetrating the surface with which it comes into contact.

Figure 7:
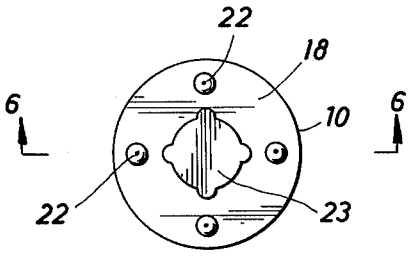
FIG. 7 is a view of the top of the improved plug of FIG. 6.

FIGS. 3–7 illustrate plugs 10 which are known as bottom plugs because they have top fluid openings 23 and bottom fluid openings 24 with a fluid passage 25 potentially in open fluid communication with the openings 23 and 24. The bottom plugs 10 are introduced with a diaphragm or membrane 26 blocking the fluid passage 25 as shown in FIGS. 3 and 6 which can be burst or broken by increased fluid pressure as shown in FIGS. 4, 5 and 7.

FIGS. 3 and 5 illustrate bottom plugs 10 where the protrusions or barbs 20 are on the top 18 and the bottom 19 of the plug 10. The top protrusion 20 of FIG. 3 has blade like ends 22*a* while the bottom protrusion 20 has pointed ends 22. Each protrusion 20 is part of a separate rod, bar or angle iron 21 in FIG. 3 while in FIG. 5 the top and bottom protrusion 20 is part of the same bar, rod or angle iron 21. Also FIG. 3 illustrates a plug 10 with a core 11 while FIGS. 5 and 6 illustrate solid plugs 10 made without a hollow core 11.

The preferred number of protrusions 20 per plug surface 18 or 19 is between 1 and 8 inclusive, more preferably between 2 and 8 inclusive and most preferably between 4 and 6 inclusive.

Figure 8:
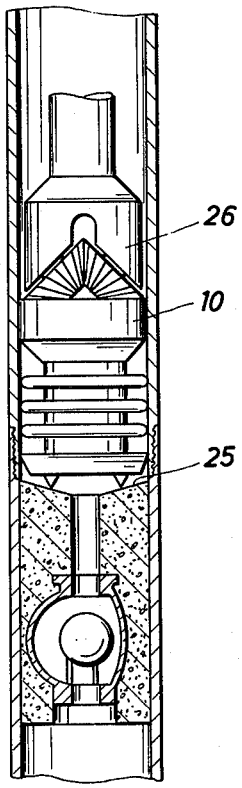
FIG. 8 is a side view of an improved pump down wipe plug positioned in a well.

The improved process of drilling through a pump down wipe plug 10 as illustrated in FIG. 8 comprises lowering a rotating drill bit 26 into a well and on to the top surface 18 of a pump down wipe pump 10 having at least one protrusion or tooth-like means 20 of at least 1.27 centimeters in length protruding from the bottom surface 19 of the plug which engages the surface below the plug thereby holding the plug 10 stationary or retarding its tendency to rotating so that most of the effective drilling energy goes into drilling the plug 10, not rotating the plug 10.

Figure 9:
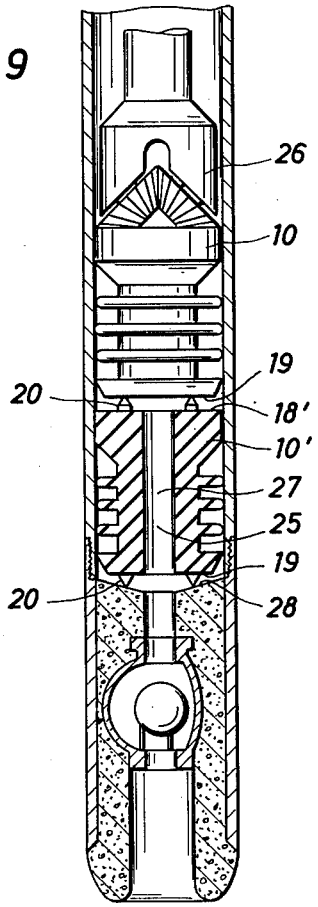
FIG. 9 is a sectional view of an improved bottom pump down wipe plug positioned in a well.

The improved process of drilling through a top plug 10 and a bottom plug 10′ as illustrated in FIG. 9 where the tendency of the top plug 10 to rotate is retarded by at least one protrusion 20 of at least 1.27 centimeters protruding from the top surface of the bottom plug 10′ which engages the bottom of the top plug 19 and where the tendency of the bottom plug 10′ to rotate is retarded by at least one protrusion 20 protruding from the bottom surface of the bottom plug 19′ which engages the cement below the bottom surface of the bottom plug 19′.

An embodiment of the improved process of drilling through the combination of a top plug 10 and a bottom plug 10′ where a rotating drill bit 26 is lowered onto the top surface 18 of a top plug 10 whose tendency to rotate is retarded by at least one protrusion 20 protruding above the top surface of the bottom plug 18′ and engaging and holding the top plug 10 while the tendency of the bottom plug 10′ is retarded by cement core 27 that has set in the fluid passage 25 of the bottom plug 10′ where that cement is part of the total cement which was pumped into the well. The effectiveness of the cement core 27 in retarding the rotation of the bottom plug 10′ is enhanced when the cross section of the fluid passage 25 which forms the mold for the cement core 27 is asymmetrical or has longitudial ribs as shown in FIGS. 6 and 7.

An improved cementing process where a pump down wipe plug 10 is inserted into the pipe as the interface between the wet cement and the fluid used to pump the wet cement to the desired level, said plug 10 having at least one protrusion or tooth-like means 20 protruding from its bottom surface 19, the cement pumped to the desired level by forcing the plug 10 down the pipe until the protrusion 20 is in contact with the top surface of a cement shoulder or a collar or shoe 28.

The improved process of cementing where a bottom plug 10' is introduced into the pipe as an interface between the wet cement and the fluid the cement is displacing, said bottom plug having at least one protrusion 20 extending from its bottom suffact 19, and a top plug 10 is introduced into the pipe as an interface between the wet cement and the fluid forcing the wet cement to the desired level, said top plug 10 having at least one protrusion 20 extending from its bottom surface 19 and pumping the plugs and cement down the pipe until the bottom plug 10' is in contact with the top surface 28 of the cement restriction of a collar or shoe.

Another embodiment of the improved cementing process comprises inserting a bottom pump down wipe plug 10' into the well pipe as an interface between the cement and the fluid it is displacing where the bottom plug 10' has at least one protrusion 20 extending from its bottom surface 19 and at least one protrusion extending from its top surface 18, pumping in the desired amount of cement then a top plug as an interface between the wet cement and the fluid used to pump the cement to the desired level and pumping the two plugs and cement until the protrusions 20 on the bottom 19 of the bottom plug 10' are in contact with the top surface 28 of the shoulder of a collar or shoe and the top plug 10 is in contact with the protrusions 20 on the top 18 of the bottom plug 10'.

I claim as my invention:

1. An improved first pump down wipe plug comprises the first plug having at least one drillable bottom sharp tooth extending at least 1.27 centimeters below the bottom surface of the first plug, said bottom tooth being capable of engaging, denting and penetrating the top surface of a second pump down wipe plug or the shoulder of a collar or shoe the first plug contacts during a cementing drilling operation and retarding the tendency of the first plug to slide over said top surface when contacted by a rotating drill bit.

2. The improved pump down wipe plug of claim 1 where the plug is a bottom pump down wipe plug having at least one drillable top sharp tooth extending at least about 1.27 centimeters above the top surface of the plug, said top tooth being capable of engaging, denting, penetrating and rending a second pump down wipe plug when said second plug is contacted with a rotating drill bit.

3. An improved bottom pump down wipe plug comprises the plug having between 2 and 8 inclusive, sharp teeth extending at least 1.27 centimeters above the top surface of the bottom plug said teeth being capable of engaging, denting and penetrating the bottom surface of a top pump down wipe plug, retarding the tendency of the top plug to rotate when contacted with a rotating drill bit.

4. The improved plug of claims 1,2 or 3 where the tooth is part of a rod, bar or angle iron between about 4 and about 16 centimeters in length, embedded and fixed in the body of the plug and made of a material selected from the group consisting of drillable metal, plastic or wood.

5. The improved plug of claim 4 where the number of teeth per surface is between 4 and 6 inclusive.

6. The improved plug of claim 5 where the teeth are made of aluminum.

7. An improved pump down wipe plug comprises a plug having 4 to 6 inclusive sharp teeth extending between 1.27 centimeters and about 8 centimeters below the bottom surface of the plug, where the teeth are part of an aluminum rod of a length of about 4 to about 16 centimeters, embedded and fixed into the body of the plug, said teeth being sharp enough and strong enough to engage the surface of another plug or shoulder of a collar or shoe with which they come in contact and retard the tendency of the plug to rotate when contacted by a rotating drill bit.

8. The improved plug of claim 7 where the plug is a bottom pump down wipe plug having 4 to 6 inclusive teeth extending about 1.27 to about 8 centimeters above the top surface of the plug, where the teeth are part of an aluminum rod of a length of about 4 to about 16 centimeters, embedded and fixed into the body of the plug, said teeth being sharp enough and strong enough to engage a top pump down wipe plug and retard the top plugs tendency to rotate when contacted with a rotating drill bit.

9. An improved pump down wipe plug comprises a bottom pump down wipe plug having 4 to 6 inclusive teeth extending about 1.27 to about 8 centimeters above the top surface of the plug, where the teeth are part of an aluminum rod of a length of about 4 to about 16 centimeters, embedded and fixed into the body of the plug, said teeth being sharp enough and strong enough to engage a top pump down wipe plug and retard the top plugs tendency to rotate when contacted with a rotating drill bit.

10. An improved cementing and drilling process comprises:

(a) inserting a bottom pump down wipe plug having at least one drillable tooth extending above its top surface and at least one drillable tooth extending below the bottom surface into a cementing pipe string;

(b) introducing the desired amount of wet cement into the string behind the bottom plug;

(c) inserting a top pump down wipe plug immediately following the wet cement;

(d) pumping the wet cement and plugs down the pipe until the teeth on the bottom plug engage the top surface of a well shoe or collar pipe attachment, the cement has passed through the bottom plug and the pipe attachment and the top plug engages the teeth extending from the top of the bottom plug;

(e) allowing the cement to set;

(f) drilling out the top plug with a rotating drill bit, the tendency of the top plug to rotate being retarded by the teeth extending above the top surface of the bottom plug and into the bottom of the top plug; and (g) drilling out the bottom plug with a rotating drill bit, the tendency of the bottom plug to rotate being retarded by the teeth extending below the bottom surface of the bottom plug and engaging the top surface of the pipe attachment.

11. An improved cementing and drilling process comprises:

(a) inserting a pump down wipe plug having at least one tooth extending below its bottom surface as the interface between wet cement and another fluid;

(b) pumping the wet cement and plug down the well until the tooth of the plug has engaged the top of a well shoe or collar pipe attachment;

(c) allowing the cement to set;

(d) drilling out the plug by contacting top of the plug with a rotating drill bit, the tendency of the plug to rotate being retarded by the tooth which engages the top surface of the pipe attachment, thereby enhancing the drilling action of the bit on the plug.

12. An improved down hole well pipe configuration comprising:

(a) a well shoe or collar pipe attachment, and (b) a pump down wipe plug having at least one drillable bottom tooth made of a material selected from the group consisting of cast iron and aluminum protruding from its bottom surface, said tooth in contact with the top surface of the pipe attachment.

13. The improved configuration of claim 12 where the plug is a bottom pump down wipe plug having at least one drillable top tooth made of a material selected from the group consisting of cast iron and aluminum, protruding from the top surface of the bottom pump down wipe plug, said configuration including a top pump down wipe plug, the bottom surface of the top pump down wipe plug being in contact with the top tooth of the bottom pump down wipe plug.

14. The improved configuration of claim 12 where the plug is a bottom pump down wipe plug, said configuration including a top pump down wipe plug having at least one drillable tooth protruding from the bottom of the top pump down wipe plug in contact with the top surface of the bottom pump down wipe plug.

15. An improved drilling process comprises:

(a) inserting a first pump down wipe plug having at least one drillable tooth extending below the bottom surface, into a cementing pipe string;

(b) pumping the first plug down the pipe string until the tooth or teeth on the bottom surface of the first plug contact the top surface of a second plug or shoulder of a collar or shoe;

(c) and drilling out the first plug with a rotating drill bit, the tendency of the first plug to rotate being retarded by the tooth or teeth extending below the bottom of the first plug and engaging the top surface.

16. An improved cementing and drilling process comprises:

(a) inserting a bottom pump down wipe plug having at least one drillable tooth extending below its bottom surface into a cementing pipe string;

(b) introducing the desired amount of wet cement into the string behind the bottom plug;

(c) insert a top pump down wipe plug having at least one drillable tooth extending below its bottom surface into the string following the wet cement;

(d) pumping the bottom plug and top plug down the pipe string until the tooth or teeth of the bottom plug engage the shoulder of a collar or shoe and the tooth or teeth of the top plug engage the top of the bottom plug;

(e) drilling out the top plug with a rotating drill bit, the tendency of the top plug to rotate being retarded by the tooth or teeth extending below the surface of the top plug and into the top surface of the bottom plug; and (f) drilling out the bottom plug with a rotating drilling bit, the tendency of the bottom plug to rotate being retarded by the tooth or teeth extending below the surface of the bottom plug and engaging the top surface of the shoulder.

* * * * *